United States Patent [19]

Kunczynski

[11] 4,403,552

[45] Sep. 13, 1983

[54] DETACHABLE GRIP ASSEMBLY AND METHOD

[76] Inventor: Jan K. Kunczynski, 2400 Arrowhead Dr., Carson City, Nev. 89701

[21] Appl. No.: 328,932

[22] Filed: Dec. 9, 1981

[51] Int. Cl.[3] ..... B61B 12/12

[52] U.S. Cl. ..... 104/206; 104/204; 104/216

[58] Field of Search ..... 104/202, 204–206, 104/209, 211, 212, 214, 216; 24/132 WL, 133, 134 KB, 134 N

[56] References Cited

U.S. PATENT DOCUMENTS

| | | | |
|---|---|---|---|
| 611,570 | 9/1898 | Dusedau | 104/206 |
| 694,029 | 2/1902 | Sackett | 104/206 |
| 729,558 | 6/1903 | Dusedau | 104/206 |
| 2,955,544 | 10/1960 | Guirand | 104/206 X |
| 3,785,296 | 1/1974 | Berry et al. | 104/209 X |
| 3,827,372 | 8/1974 | Laurent | 104/209 |

*Primary Examiner*—Randolph Reese

*Attorney, Agent, or Firm*—Manfred M. Warren; Robert B. Chickering; Glen R. Grunewald

[57] ABSTRACT

A grip assembly and method for detachably mounting a chair, gondola or the like to a movable cable is disclosed. The grip assembly includes a movable jaw, spring biasing means coupled to bias the jaw to a closed position, and jaw actuating means in the form of opposed toggle joints coupled to move the jaw between open and closed positions upon the application of equal, opposite and aligned forces to knee portions of the toggle joints. A mechanism for applying the actuating forces to the grip assembly is also disclosed.

9 Claims, 6 Drawing Figures

DETACHABLE GRIP ASSEMBLY AND METHOD

BACKGROUND OF THE INVENTION

While many chairlifts, gondolas, ski lifts, trams and the like are permanently secured to the endless cable which conveys them, numerous aerial tranmway installations are constructed so that the personnel conveying chair or lift may be detached from the cable and reattached when and where desired. A typical detachable aerial tramway installation will include loading and unloading platforms proximate each end of the lift. As the chair or gondola approaches the loading and unloading platform, a mechanism engages the chair grip assembly and causes the grip to open and release the chair from the cable. The cable operates continuously, but the chair which has been released can be stopped for loading and unloading. Usually, the grip assembly and chair are lifted up off the moving cable by guide rollers and tracks, and the chair or gondola can be pushed by hand on the guide tracks from the unloading station around to a loading station. After loading the passengers into the chair or gondola, the operator advances the same along the track, which allows the grip to drop down onto the cable, and a grip attaching mechanism causes the grip to engage the cable on the fly so that chair or gondola again advances with and is carried by the cable.

Prior grip assemblies for detachably mounting chairs, gondolas and the like to moving cables have been found to have several disadvantages in their construction and operation. Primary among the disadvantages have been the problems associated with actuating, opening and closing, the gripping jaws of the assembly. This is usually accomplished by providing the grip assembly with a lever that can be pushed to open and to close the gripping jaws. In order to push the lever, however, the prior art grip assemblies have required rather cumbersome and complex support guides which can resist the moment induced about the longitudinal axis of the cable as a result of pushing on the actuating lever. Additionally, the displacement of the actuating lever will also cause a lateral displacement of the grip and cable unless the grip assembly is supported in the manner resisting the force on the lever. Since opening and closing of the cable grip usually takes place while both the cable and grip are moving, the grip assembly support problems at the loading and unloading terminals are substantial.

OBJECTS OF THE INVENTION

It is an object of the present invention to provide a grip assembly for detachably mounting a chair, gondola, ski lift, tram or the like to a movable cable which is capable of generating an extremely high gripping force and yet may be opened and closed with relative ease and a relatively simple actuating structure.

It is another object of the present invention to provide a grip assembly for detachably mounting an aerial tramway to an endless cable which does not require complex and bulky grip support structures to enable opening and closing of the cable gripping jaws.

Another object of the present invention is to provide a method for attaching and detaching a chair, gondola or the like to a moving cable by the application of a balanced moment-free, lateral thrust-free actuating force to the grip assembly.

Still another object of the present invention is to provide a method for attaching and detaching a chair, gondola or the like to an endless cable by means of a grip assembly having a movable jaw and means for actuating the same in which the actuating force also provides support for the grip assembly during the opening and closing operations.

Still a further object of the present invention is to provide a detachable grip assembly for an aerial tramway which has improved simplicity of construction and operation, is durable and maintenance free, and is biased toward gripping of the cable or "fail safe" operation.

The grip assembly and method of the present invention have other objects and features of advantage which will become apparent from the following description of the preferred embodiment and the accompanying drawing.

SUMMARY OF THE INVENTION

The grip assembly of the present invention includes cable gripping jaw means formed for movement between an open and a closed position, spring biasing means coupled to bias the jaw means to the close position, and jaw actuating means formed to urge the jaw means between the open position and the closed position upon application of an actuating force to the jaw actuating means. The improvement in the grip assembly is comprised, briefly, of the jaw actuating means being formed for the application of substantially equal and opposite actuating forces to the grip assembly from opposite sides thereof and from substantially moment-free and laterial thrust-free positions on the grip assembly. This is preferably accomplished by forming the jaw actuating means as a pair of oppositely facing toggle joint means having knee portions formed and position for the application of aligned and opposed actuating forces to the toggle joints so that the actuating forces support the grip assembly during the opening and closing of the grip jaws. The grip assembly further includes auxiliary knee portions which can be symmetrically engaged to apply an actuating force which will cause toggling of the toggle joints in an opposite direction for closing of the grip jaws around the cable.

In the improved method of the present invention the application of an actuating force to the grip assembly is accomplished by applying the force from opposite sides of the grip assembly at moment-free and lateral thrust-free locations so that the force applied also supports the grip assembly during the opening and closing thereof.

DESCRIPTION OF THE PREFERRED EMBODIMENT

Figure 1:
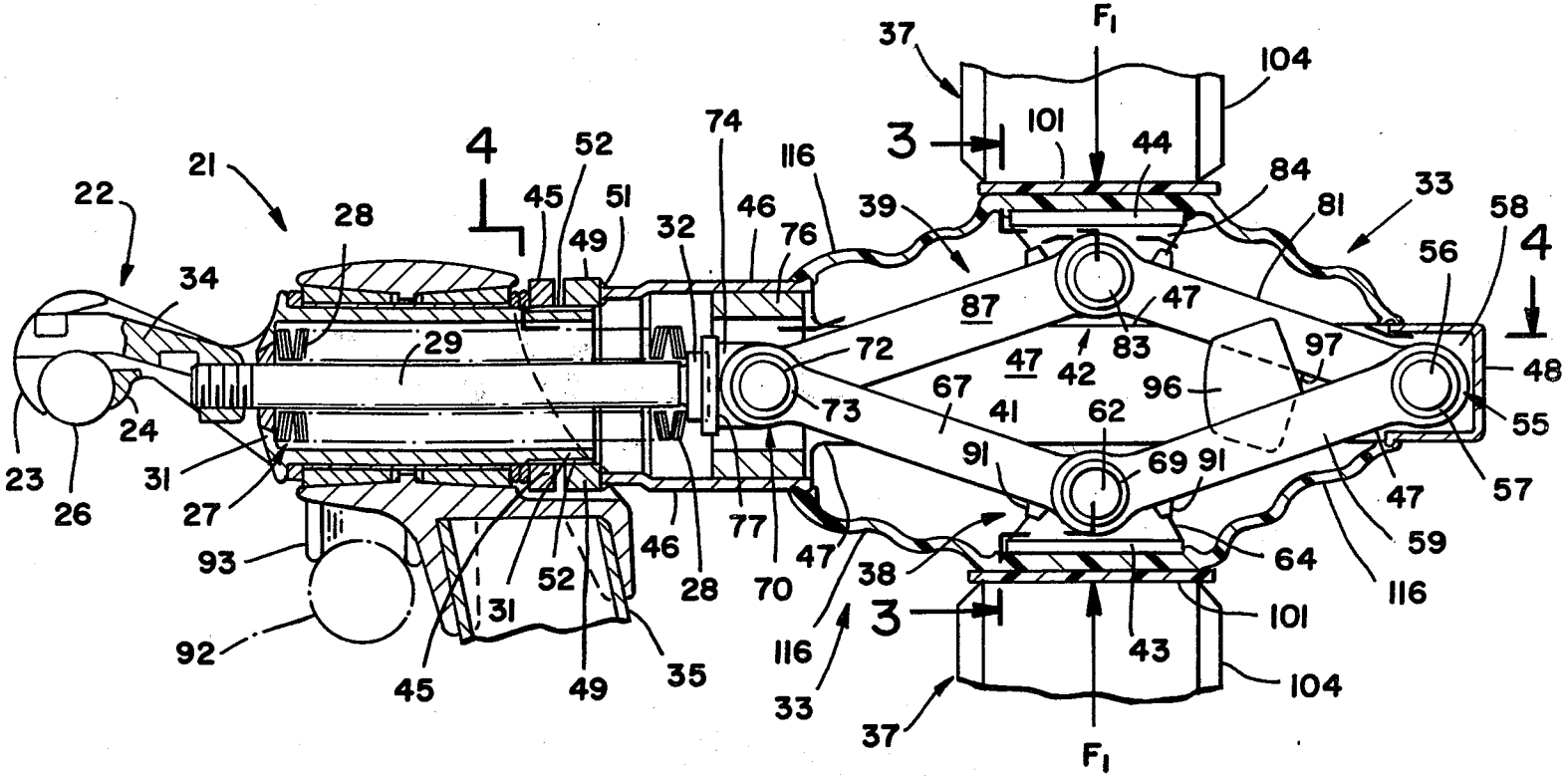
FIG. 1 is a side elevational view, in cross-section, of a grip assembly constructed in accordance with the present invention and shown gripping a cable.
Figure 2:
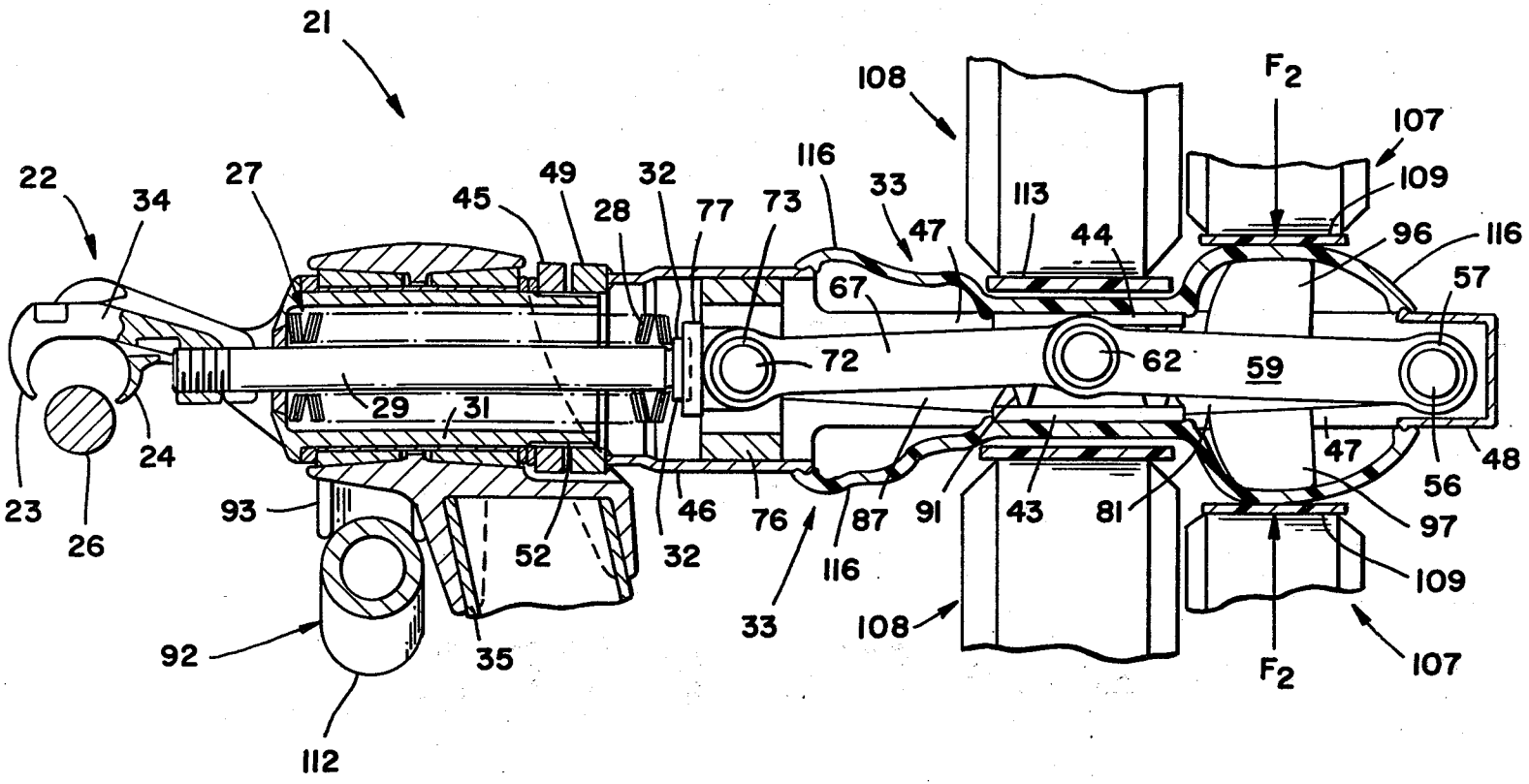
FIG. 2 is a side elevational view, in cross-section, of the grip assembly of FIG. 1 with the grip released from the cable.

As shown in the drawing, grip assembly 21 includes jaw means 22, here constructed with a movable jaw member 23 and a stationary jaw member 24, which jaw means is resiliently biased for gripping of endless cable 26. Biasing of movable jaw member 23 toward jaw 24 is accomplished by spring biasing means, generally designated 27 and here shown as a stack of Belleville springs 28 which are mounted axially around rod or bolt 29 and bear on housing 31 at one end and on enlarged portion or head 32 of bolt 29 at the other end. As will be apparent, springs 28 will tend to displace bolt 29 to the right, as seen in FIGS. 1 and 2, causing jaw 23 to be pulled toward stationary jaw 24.

Rotatably suspended from cylindrical grip housing 31 is a hanger arm 35 on which a chair, gondola or tram body can be supported. The manner of supporting hanger arm 35 for rotation about the longitudinal axis of the housing and bolt 29 is set forth in detail in my co-pending application Ser. No. 249,003, filed Mar. 30, 1981, and entitled "FRICTION-BASED, MOTION DAMPING ASSEMBLY FOR A CHAIRLIFT OR THE LIKE," and such mounting structure will not be described in detail herein.

In order to provide for opening and closing of jaw means 22, the grip assembly of the present invention further includes jaw actuating means, generally designated 33. As is true in connection with prior art structures, jaw actuating means 33 is coupled to jaw means 22 so as to enable the application of an actuating force which will open and close the cable gripping jaws. Thus, jaw actuating means 33 is formed to displace bolt 29 and accordingly the movable jaw carrying arm 34 and jaw member 23 to the left against biasing means 27 until the jaw is in the open position shown in FIG. 2. Additionally, jaw actuating means 33 must be formed to enable reversal of the procedure so that the jaws are moved from the open position of FIG. 2 to the closed position of FIG. 1.

As thus far described, the grip assembly of the present invention broadly contains elements found in prior art structures. The improvement of the present invention, however, resides in construction of the jaw actuating means so as to enable opening and closing of the jaws by balanced actuating forces that do not induce moments or lateral thrusts in the grip assembly which would require complex grip support structures. The jaw actuating means of the improved grip assembly, therefore, is formed for the application of substantially equal and opposite actuating forces to the assembly from opposite sides thereof and from positions or locations which are substantially free of any moment or side thrust with respect to the longitudinal axis of cable 26.

As best may be seen in FIG. 1, opposed, substantially equal and aligned, actuating forces $F_1$ are applied through means, generally designated 37, to actuating means 33 to open movable jaw 23. Since actuating forces $F_1$ are opposed, aligned forces, they not only apply a force to the actuating structure which will open the jaws, they also support the grip assembly without thrusting it laterally or tending to cause the assembly to pivot about cable 26. It is not necessary, therefore, to provide a support structure for the grip assembly, as heretofore been required with detachable grips.

In the preferred form, jaw actuating means 33 is formed as lever means coupled to the jaw means for movement thereof, and more particularly, the lever means is formed as a pair of oppositely facing toggle joints, generally designated 38 and 39, each having knee portions 41 and 42 formed with shoes 43 and 44 against which actuating forces $F_1$ can be applied.

The toggle joint jaw actuating means includes frame means comprised of a cylindrical section 46, an extension section 47 and an end cap 48. The frame for the toggle joints is secured to a threaded element 49 by welding, for example at 51, and the threaded element and frame can be screwed down on the threaded end 52 of grip housing 31. A pin, now shown, can then be used to lock the element 49 to housing 31 so that the toggle joint is properly aligned for application of an actuating force by the force applying mechanism 37. Threaded element 45 is mounted on threaded end 52 of the grip housing and may be axially adjusted on end 52 independently of element 49 to apply a loading force on the damping structure for hanger arm 35, as is explained in my co-pending application Ser. No. 249,003.

It is further advantageous if the grip actuating means can be removably mounted to housing 31 for the grip assembly. This allows the same grip assembly housing to be utilized for grips which are permanently attached to the aerial tramway cable. One can simply screw the threaded element 49 off the end of housing 31 and replace bolt 29 with a shorter bolt and an end closure or cap.

Figure 3:
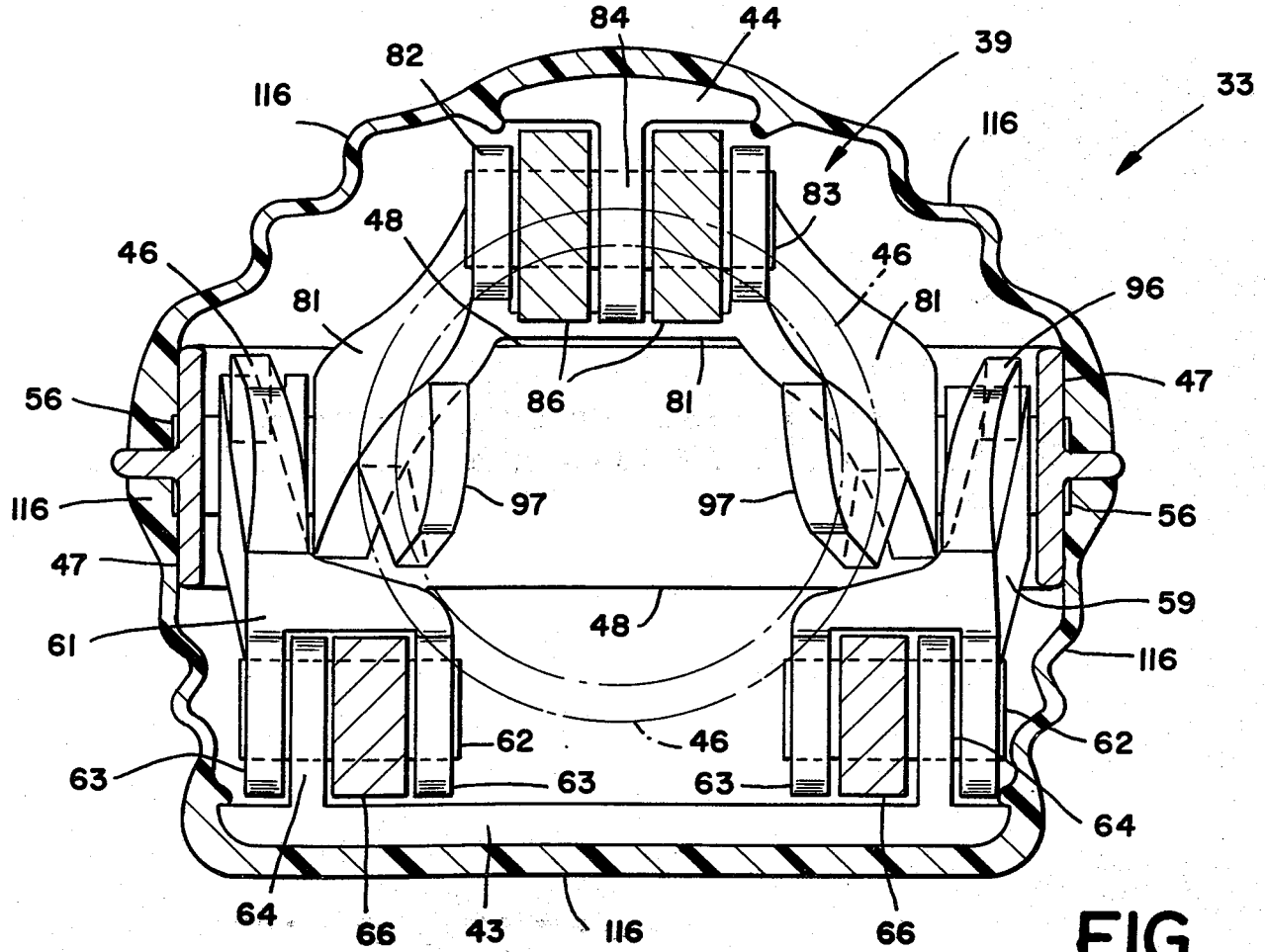
FIG. 3 is an enlarged, cross-sectional view taken substantially along the plane of line 3—3 in FIG. 1.
Figure 4:
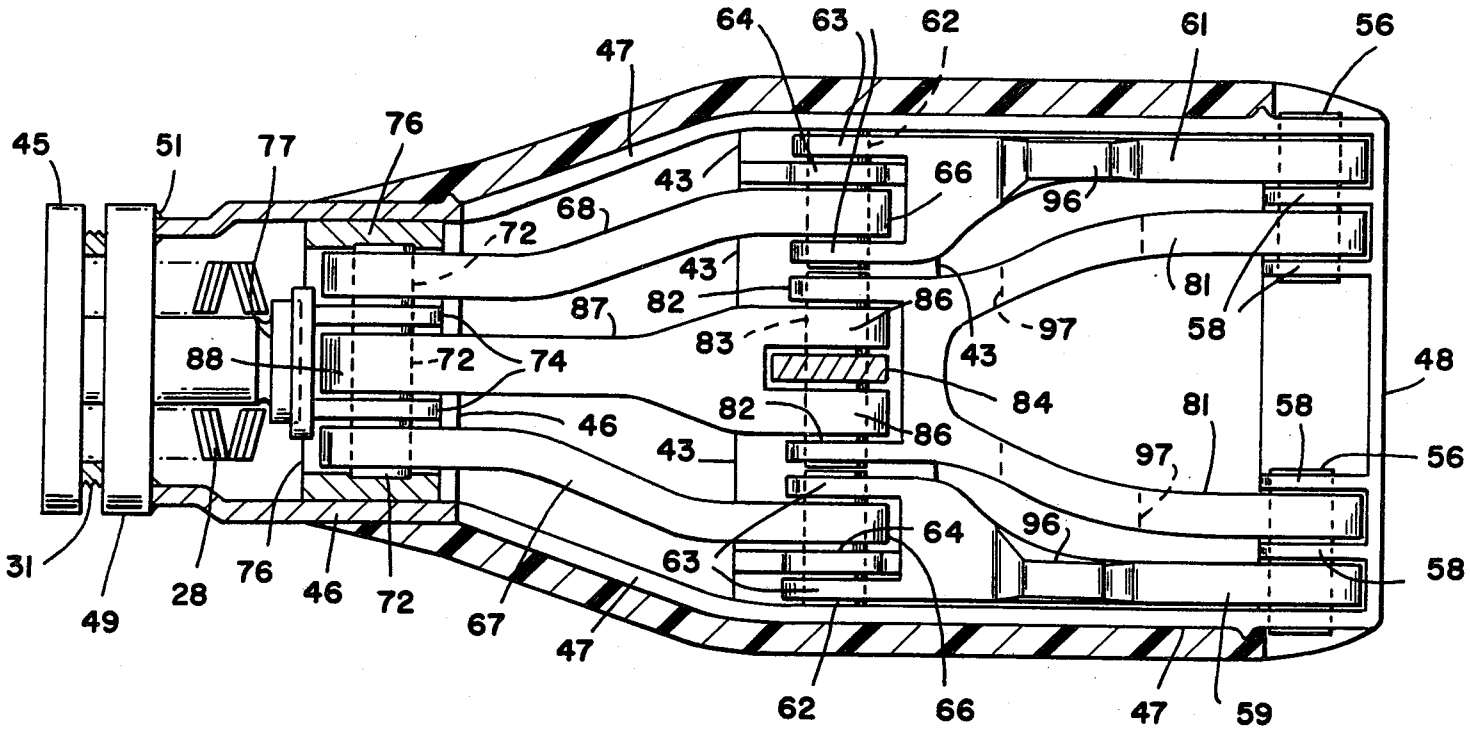
FIG. 4 is an enlarged, cross-sectional view taken substantially along the plane of line 4—4 in FIG. 1.

The details of construction of the toggle joints can best be understood by reference to FIGS. 1, 3 and 4. Toggle joint means 38 is formed by a pair of pivot pins 56 which are mounted in bearings 57 and in turn mounted to inwardly protruding ears 58 and the side walls of end cap 48. Toggle joint link members 59 and 61 are pivotally secured at first end 55 of the toggle joint frame by pins 56 so that they are immovable with respect to the frame. The opposite ends of toggle joint link members 59 and 61 are pivotally coupled by pins 62 to intermediate knee portion 41. As best may be seen in FIGS. 3 and 4, each of toggle elements 59 and 61 includes a yoke 63, and pin 62 passes through the yoke and through ears 64, which are coupled to the shoe plate 43 of knee portion 41 as well as to ends 66 of toggle members 67 and 68. Thus, pins 62 pivotally connect toggle link members 67 and 59 to shoe 43 at knee portion 41 of the toggle joint and similarly pin 62 couples toggle members 61 and 68 together to shoe 43. Again, suitable bearings 69 are interposed between pins 62 and the members which are coupled to them.

At a second end 70 of the toggle jointframe, lower toggle joint means 38 has a transverse pin 72, bearing means 73, and a pair of ears 74. Toggle link members 67 and 68 are pinned to a sliding cylindrical member 76 mounted for reciprocation inside cylindrical section 46 of the frame for the toggle joint. Mounted on the end of ears 74 is a socket member formed for receipt and mating engagement with the enlarged end 32 of bolt 29.

The upper or opposed toggle joint means 39 is formed in a manner which is analogous to lower toggle joint means 38, with the exception that the upper toggle joint is constructed so that it falls inside the lower toggle joint, it being understood that the relationship could be reversed. If, for example, threaded element 49 were pinned to grip housing 31 at 180° from that shown in FIG. 1, toggle joint 39 would now be in a lower position and inside toggle joint 38.

Toggle joint 39 includes a yoke-shaped member 81 which is pinned proximate first end 55 of the toggle joint frame by pins 58 so as to be secured to the toggle joint frame. The ears 82 are pinned by pivot pin 83 to an ear 84 attached to shoe 44 and to the ends 86 of toggle link member 87. The end 88 of toggle member 87 inturn is pinned by pin 72 to the cylindrical reciprocating member 76.

In operation, actuating force $F_1$ applied to shoes 43 and 44 urges knee portions 41 and 42 of the toggle joints from a first stable position as shown in FIG. 1 toward each other. As the knee portions approach each other, the toggle members tend to straighten out causing axially displaceable guide member 76 to slide within cylindrical frame section 46 so as to urge bolt 29 to the left, as viewed in FIG. 1. In fact, the actuating force also tends to urge first end 55 of the toggle frame to the right, as viewed in FIG. 1, which reaction is transmitted to extension 47, cylindrical frame 46, and grip housing 31. This reaction causes the fixed jaw 24 to move to the right away from cable 26 at the same time, and to the same extent, as movable jaw 23 is moved to the left as the guide member 76 slides in frame section 46. As will be seen in FIG. 2, therefore, both jaws 23 and 24 have moved outwardly from cable 26. The vertical displacement of the jaws with respect to cable 26, as shown in FIG. 2, will be explained hereinafter.

As actuating force $F_1$ is applied to opposed toggle joints 38 and 39, the axial force on bolt 29 increases substantially as the members approach the horizontal or the toggle point or line. When members 67 and 59 and 81 and 87 are in alignment between the central axis of pins 56 and 72, the toggle point has been reached. The joint also becomes unstable end will tend to go beyond the toggle point or line, particularly in light of the fact that the opposed toggle joints are constructed so that they may pass one within the other.

In the toggle joint of the present invention, the toggle members go through the toggle point to a second stable position beyond the toggle point, as best may be seen in FIG. 2. In order to prevent the toggle joint from going far beyond the toggle point, it is preferable to provide stop means which limit the movement of the toggle arms to the second stable position shown in FIG. 2. Stop means 91, for example, can be provided on the toggle lever arms which will engage the shoes as the arms go slightly beyond the toggle point. This will cause each of the toggle joints to come to a steady state or stable second position.

Once the jaws no longer grip cable 26, it is preferable and desirable to lift the grip assembly up off the cable so that the chair, gondola or the like can be slowed to a stop while the cable continues moving. The lifting of the grip assembly upwardly off the cable ensures that the jaws do not inadvertently contact the cable. This lifting action can be accomplished by a number of different techniques, but the one most commonly used is to provide a track or tube 92 (shown in phantom in FIG. 1 and in solid lines in FIG. 2) which is engaged by a pair of sheaves 93 (only the sheave on the far side of the grip is shown) mounted to or carried by grip assembly 21 on a bracket (not shown). The guide tube or track 92 can be gradually upwardly sloped, as is shown at 94 in FIG. 5A so that pulley 93 will engage the upward sloping section 94 at about the same time that the actuating force applying mechanism 37 opens the jaws. Although not shown, it is also possible to provide braking mechanisms for the chair or gondola once it has been separated from the cable.

The detached chair or gondola can now be guided on track 92 around the terminal by an attendant independently of the continuous operation of the cable. Passengers can be unloaded from the chair and thereafter other passengers loaded into the chair. Usually the unloading operation will take place on one side of the terminal and the loading operation on the other, with the chair passing around horizontal bull wheel 106 on guide track 92.

When it becomes necessary to attach the grip assembly to the cable for movement of the chair or gondola with the cable, the toggle joint actuating means of the present invention must be constructed in a manner which will allow the joint to be moved from the position of FIG. 2 back to the position of FIG. 1 so as to close the jaws on the cable. This is accomplished in the joint of the present invention by providing auxiliary knee portions 96 and 97 which are carried by the opposed toggle joints 38 and 39. As shown in the drawings, knee portion 96 is provided by a pair of upwardly extending members 96 on toggle members 59 and 61. Auxiliary knee portion 97 is provided by downwardly depending members 97 on the underneath surfaces of yoke-shaped toggle member 81. When in the position of FIG. 1, these auxiliary knee portions are in between the toggle joints, but when the joints are urged to the position of FIG. 2, the auxiliary knee portions project outwardly of the toggle joint members. Thus, an actuating force $F_2$ can be applied to auxiliary knee portions 96 and 87 to enable the toggle joints to be urged from the second stable position shown in FIG. 2 past the toggle point and back toward the first stable position shown in FIG. 1.

Since spring biasing springs 28 would cause the toggle joints to snap back violently to the position of FIG. 1 as the members go through the toggle point, it is preferable that shoes 43 and 44 be engaged and supported for controlled movement back to the closed position of FIG. 1 in which further outward displacement of the toggle joint members is limited by engagement of jaws 23 and 24 which cable member 26.

Figure 5A:
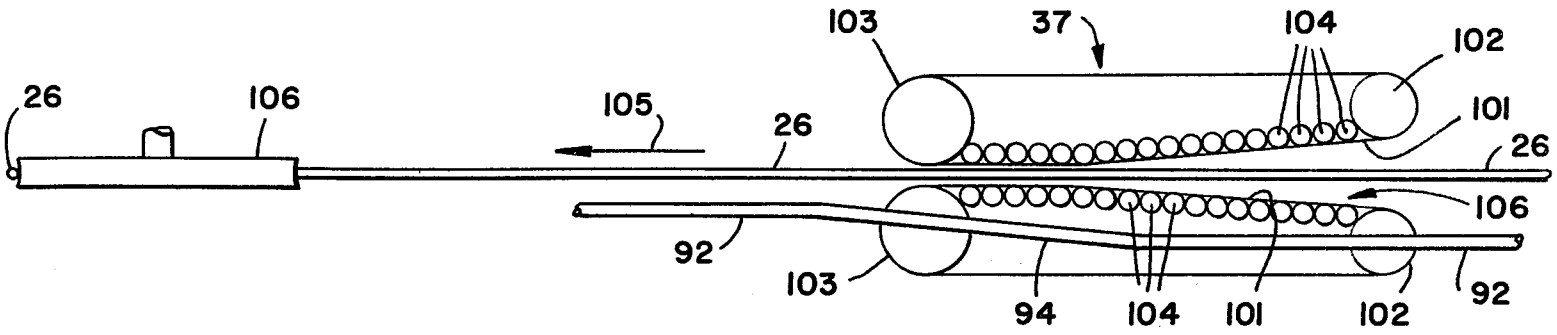
FIG. 5A is a schematic representation of a grip actuating mechanism at an unloading station suitable for use in opening the jaws of the grip assembly of the present invention.
Figure 5B:
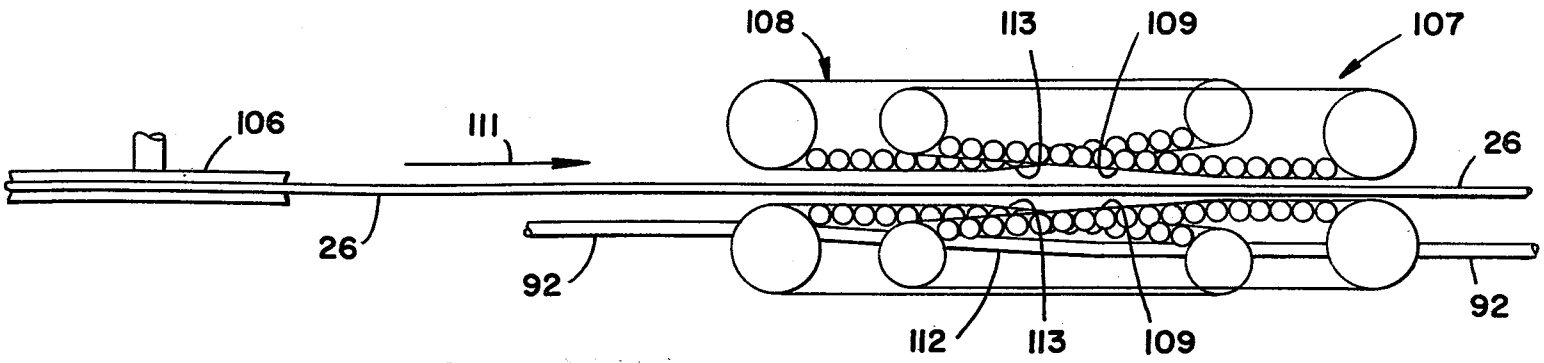
FIG. 5B is a schematic representation of a grip actuating mechanism at a loading station suitable for use in closing the jaws of the grip assembly of the present invention.

Referring now to FIGS. 5A and 5B, the actuating mechanism for opening and closing the grip assembly is schematically illustrated. A first actuating force applying assembly 37 is mounted for engagement of the cable grip assembly as it reaches the loading and unloading terminal. The first assembly engaging means includes means for progressively applying balanced and opposed actuating forces to actuating means 33 of the grip assembly. This can be provided, for example, by a belt and roller mechanism in which belt 101 is mounted between rollers 102 and 103 and a plurality of small bearing rollers 104, which progressively apply a greater force in a converging section 106 between the opposed assemblies. The rollers 104 preferably are small enough in diameter so that the shoes 43 and 44 do not fall between the rollerss 104, but are continuously supported on the same.

The distance between the converging belt and roller assemblies is selected so as to ensure the displacement of shoes 43 and 44 past the toggle point so that the jaws will snap to the open position of FIG. 2. The rate of convergence can be selected so that the transition or detachment of the grip assembly from the cable, which is moving in the direction of arrow 105, is smooth and uniform. One can tailor the convergence to the axial force required to overcome spring biasing members 28.

In FIG. 5B the mechanism, or second grip assembly engaging means, for attaching the grip assembly 21 to cable 26 is illustrated. Normally this attaching mechanism will be on the opposite side of bull wheel 106 from the detaching mechanism shown in FIG. 5A. In order to ensure a controlled movement of the grip assembly from the open to the closed position, a converging assembly 107, which applies an actuating force $F_2$ to the auxiliary knee portions, and a diverging or supporting assembly 108, which supports knee portions 41 and 42 to prevent snap back as the toggle joints pass the toggle point, are provided. The converging assembly 107 is constructed in a manner similar to the assembly 37 of FIG. 5A, while the diverging assembly 108 complements the rate of convergence of the converging assembly to provide support once the toggle point has been reached. Thus, as opposed belts 109 converge against knee portions 96 and 97, the knees are urged toward each other as the grip assembly advances in the direction of advancing cable 26, as indicated by arrow 111. The grip assembly is traveling on guide track 92, and as it enters the converging assembly 107, guide track 92 includes a sloped portion 112 that causes the grip to descend down onto the cable as the grip is being closed by roller supported belts 109. At the toggle point, opposed diverging belts 113 are positioned closely proximate or have just engaged shoes 43 and 44 for support of the toggle joints, as urged toward the position of FIG. 1 by the stacked springs 28. Opposed belts 109 no longer control the motion of the toggle joints, which simply move toward the position of FIG. 1 and full gripping of cable 26 at a rate determined by diverging opposed roller supported belts 113. Similarly, the rollers which had engaged guide track 92 come out of engagement with the track as the grip clamps down on the cable. Guide track 92 can be extended to limit lateral motion or to stablize the chair or gondola as it comes up to speed with the cable during the gripping process so that the chair or gondola is not swinging when it leaves the terminal.

As will be appreciated, the rate of convergence and divergence and the relative positioning of the grip actuating assemblies 107 and 108 together with the degree of slope of the guide track 92 can and should be coordinated so as to smoothly accelerate the chair or gondola to a speed approximately the cable speed and to smoothly close the grip around the cable so as to reattach the assembly for movement with the cable.

It is preferable to form the toggle members of the grip actuating means of the present invention as metalic members formed of aluminum or other corrosion resistent metals. Similarly, the frame for the toggle joints and shoes can be formed of a corrosion resistant metal. It is further preferable to provide a resilient flexible shield or boot 116 formed from a material such as natural or synthetic rubber and molded so as to conform to shoes 43 and 44 and to mate with ribs or protrusions at the cylindrical section 46 and end cap 48 of the frame. The boot should have sufficient flexibility and material so as to permit auxiliary knee portions 96 and 97 to protrude outwardly for engagement by opposed belts 109.

What is claimed is:

1. A grip assembly for detachably mounting a chair, gondola or the like to a movable cable for transport thereof, said grip assembly including cable gripping jaw means formed for movement between an open position and a closed position, spring biasing means coupled to said jaw means and formed to generate sufficient gripping force in said jaw means to attach said grip assembly to said cable, and jaw actuating means formed for the application of substantially equal and opposite actuating forces to said grip assembly from opposite sides thereof and from substantially moment-free and lateral thrust-free positions on said grip assembly to urge said jaw means between said open position and said closed position, wherein the improvement in said grip assembly is comprised of:

said jaw actuating means being formed as a pair of oppositely facing toggle joint means each having knee portions formed for application of said actuating forces thereto, said toggle joint means being further coupled to said jaw means for transmission of actuating forces sufficient to overcome said gripping force generated by said spring biasing means, said toggle joint means being formed for movement between a stable position on one side of a toggle line to another stable position on an opposite side of said toggle line, and said spring biasing means being formed to maintain said toggle joint means in both of the stable positions.

2. A grip assembly as defined in claim 1 wherein said jaw actuating means is coupled to said jaw means in a manner enabling removal from the remainder of said grip assembly and operation of said jaw means independently of said jaw actuating means.

3. A grip assembly as defined in claim 1 wherein, said jaw activating means is provided by:

(i) frame means secured to the remainder of said grip assembly, (ii) a first pair of link members each pivotally secured at one end to said frame means and each having an opposite end free for movement with respect to said frame means, (iii) a second pair of link members each pivotally connected at one end to the opposite ends of said first pair of link members and each having an opposite end mounted for guided reciprocation with respect to said frame means, (iv) shoe means mounted to said link members proximate the pivotal connection therebetween and formed for the application of said actuating force thereto, and (v) said jaw means having a fixed portion coupled to said frame means and a movable portion positioned for displacement by the opposite ends of said second pair of link members.

4. A grip assembly for detachably mounting a chair, gondola or the like to a movable cable for transport thereof, said grip assembly including cable gripping jaw means formed for movement between an open position and a closed position, and jaw actuating means including frame means, a pair of opposite toggle joint means coupled at a first end to said frame means and coupled at an opposite second end to said jaw means for displacement of a movable portion of said jaw means, said toggle joint means being further formed with knee portions positioned for the application of substantially equal and opposite moment-free actuating forces thereto to move said jaw means between said open position and said closed position, wherein the improvement in said grip assembly comprises:

flexible shield means mounted to said frame means and extending around and encasing said toggle joint means so as to substantially seal said toggle joint means against contaminants, said shield means being formed for flexible displacement with said knee portions.

5. A grip assembly for detachably mounting a chair, gondola or the like to a movable cable for transport thereof, said grip assembly including cable gripping jaw means formed for movement between an open position and a closed position, spring biasing means coupled to bias said jaw means to said closed position and jaw actuating means including frame means, a pair of opposite toggle joint means coupled at a first end to said frame means and coupled at an opposite second end to said jaw means for displacement of a movable portion of said jaw means, said toggle joint means being further formed with knee portions positioned for the application of substantially equal and opposite moment-free actuating forces thereto to move said jaw means between said open position and said closed position, wherein the improvement in said grip assembly comprises:

said toggle joint means are each formed for displacement from a first stable position on one side of a toggle line to a second stable position on an opposite side of said toggle line, said knee portions being formed for displacement of said toggle joints from said first stable position to said second stable position, and said toggle joint means each further including auxiliary knee portions formed for engagement and the application of an auxiliary actuating force thereto when said toggle joints are in said second stable position to displace said toggle joints to said first stable position.

6. A grip assembly as defined in claim 5 wherein, said spring biasing means is coupled to bias said toggle joint means toward said first position when said toggle joint means are on one side of said toggle line and toward said second position when said toggle joint means are on an opposite side of said toggle line.

7. A grip assembly as defined in claim 6 wherein, said toggle joint means and said spring biasing means are formed to bias said jaw means into gripping engagement with said cable when said toggle joint means are in said first position and are formed to bias said jaw means to an open position for release of said cable when said jaw means are in said second position.

8. An apparatus for detaching and attaching a conveying means, such as a chair, gondola or the like, to a movable cable, said apparatus including at least one conveying means, a cable grip assembly mounted to said conveying means, said grip assembly having movable jaw means, spring biasing means coupled to generate a gripping force in said jaw means for gripping engagement with said cable, jaw actuating means formed to displace said jaw means against said spring biasing means to an open position and formed for selective displacement of said jaw means from said open position back to a closed position gripping said cable, and a force applying assembly mounted for engagement with said jaw actuating means to apply an actuating force thereto, wherein the improvement in said apparatus comprises:

said spring biasing means being formed to generate sufficient gripping force in said jaw means to attach said conveying means to said cable;

said jaw actuating means being provided by toggle joint means formed for movement to and from stable positions on opposite sides of a toggle line;

said spring biasing means being coupled to maintain said toggle joint means in both of the stable positions;

said force applying assembly including first assembly engaging means formed to progressively apply balanced opposed actuating forces to said actuating means at a first pair of opposed locations to open said jaw means against said biasing means;

said force applying assembly further including second assembly engaging means formed to progressively apply balanced opposed actuating forces to said actuating means at a second pair of opposed locations to close said jaw means; and said second assembly engaging means is further formed with a diverging portion formed to regressively apply a supporting force to said actuating means in cooperation with the application of actuating forces to said actuating means by said second assembly engaging means for controlled closing of said jaw means once said toggle joint means crosses said toggle line.

9. A method of attaching and detaching a grip assembly for a chair, gondola, tram or the like to a movable endless cable, said grip assembly including a movable jaw, spring biasing means coupled to generate a gripping force in said jaw sufficient to secure said assembly to said cable, and toggle means formed for movement between two stable positions on opposite sides of a toggle line and formed to overcome said spring biasing means to open said jaw and to close said jaw, said method including the step of applying an actuating force to said toggle means to open said jaw and detach said grip assembly, after said applying step, applying equal and opposed forces to said toggle means again to close said jaw means, wherein the improvement in said method is comprised of the step of:

during the last named applying step, applying a supporting force to said toggle means to control the rate of closing of said jaw means as said toggle means crosses said toggle line.

* * * * *

UNITED STATES PATENT AND TRADEMARK OFFICE

CERTIFICATE OF CORRECTION

PATENT NO. : 4,403,552

DATED : September 13, 1983

INVENTOR(S) : Jan K. Kunczynski

It is certified that error appears in the above-identified patent and that said Letters Patent are hereby corrected as shown below:

Column 1, line 7, delete "tranmway" and insert ---tramway---;

Column 5, line 32, delete "end" and insert ---and---; and

Column 6, line 30, delete "87" and insert ---97---.

Signed and Sealed this

*Thirteenth* Day of *March 1984*

[SEAL]

*Attest:*

GERALD J. MOSSINGHOFF

*Attesting Officer*

*Commissioner of Patents and Trademarks*